US005310373A

United States Patent [19]

Treiber et al.

[11] Patent Number: 5,310,373

[45] Date of Patent: May 10, 1994

[54] METHOD FOR PRODUCING ELECTRODES FOR SPARK PLUGS AND SPARK PLUG ELECTRODES

[75] Inventors: Jürgen Treiber, Bamberg; Rainer Noack, Bietigheim-Bissingen; Klaus-Dieter Pohl, Schwieberdingen; Willi Frank, Bamberg; Volker Brendick, Gerlingen; Hans Hurbert, Priesendorf-Neuhausen, all of Fed. Rep. of Germany

[73] Assignee: Robert Bosch GmbH, Stuttgart, Fed. Rep. of Germany

[21] Appl. No.: 856,061

[22] PCT Filed: Nov. 13, 1990

[86] PCT No.: PCT/DE90/00864

§ 371 Date: May 8, 1992

§ 102(e) Date: May 8, 1992

[87] PCT Pub. No.: WO91/09438

PCT Pub. Date: Jun. 27, 1991

[30] Foreign Application Priority Data

Dec. 16, 1989 [DE] Fed. Rep. of Germany ..... 3941649

[51] Int. Cl.[5] ..... H01T 21/02

[52] U.S. Cl. ..... 445/7; 445/49; 313/136; 313/141

[58] Field of Search ..... 445/7, 49; 313/141, 313/136, 1

[56] References Cited

U.S. PATENT DOCUMENTS

| | | | |
|---|---|---|---|
| 2,783,409 | 2/1957 | McDougal | 445/7 |
| 2,955,222 | 4/1960 | Boesch | 313/141 |
| 3,407,326 | 10/1968 | Romine | 445/7 |
| 4,540,910 | 9/1985 | Kondo et al. | 313/141 |
| 4,695,759 | 9/1987 | Podiak | 445/7 |
| 4,904,216 | 2/1990 | Kagawa et al. | 445/7 |

FOREIGN PATENT DOCUMENTS

| | | | |
|---|---|---|---|
| 3433683 | 6/1985 | Fed. Rep. of Germany . | |
| 2-312176 | 12/1990 | Japan | 445/7 |
| 2172223 | 9/1986 | United Kingdom . | |

*Primary Examiner*—Paula A. Bradley
*Assistant Examiner*—Jeffrey T. Knapp
*Attorney, Agent, or Firm*—Frishauf, Holtz, Goodman & Woodward

[57] ABSTRACT

The invention relates to a method for producing a long-life, resistant spark plug for internal combustion engines. The electrode (16), according to the invention, of the spark plug is assembled from a plurality of initial parts: an initial part for a corrosion-resistant shell (31'), an initial part for a core (33') of high thermal conductivity, and an initial part for an erosion-resistant region (32'). These initial parts are jointly impact-extruded to form an electrode blank which is formed into the center electrode (16) by machining its head (51) and its region on the combustion-chamber side. Electrodes which are especially highly stressed are given a fourth initial part, which is also to be impact-extruded, consists of highly erosion-resistant material and is still arranged on the combustion-chamber side in front of the erosion-resistant region (32'). The electrode (16) can be used as a center electrode (16), but can also be used, if necessary, as an earth electrode after an embossing and bending process.

14 Claims, 3 Drawing Sheets

METHOD FOR PRODUCING ELECTRODES FOR SPARK PLUGS AND SPARK PLUG ELECTRODES

FIELD OF THE INVENTION:

The present invention relates generally to a method for producing spark plug electrodes, and to a spark plug so made. Background: Such a method has already been disclosed by U.S. Pat. No. 2,955,222, in which a composite body which is assembled from three initial parts of different material is formed by impact extrusion into a spark plug centre electrode; the composite body has a rivet-shaped spark section, which consists of noble metal and fills up the throughbore of a round blank made from nickel with its countersunk head and a part of its shank, and there being soldered onto the side of the nickel round blank which accommodates the head of the spark section a copper round blank of the same diameter. After the impact extrusion, the copper initial part then forms the electrode core of high thermal conductivity, and the nickel initial part the corrosion-resistant electrode shell from the floor of which the spark section projects on the combustion-chamber side in the shape of a rod. The spark section of this centre electrode does permit good accessibility of the fuel-vapour-/air mixture to the spark gap of the spark plug, but its attachment to the centre electrode is in need of improvement for use in modern high-efficiency internal combustion engines.

Japanese Patent 4,922,989 discloses a spark plug with a centre electrode which has a copper core, a nickel shell and a spark tip made from platinum, gold, palladium or the like, the spark tip material being in direct contact with the core material. This centre electrode was produced by impact extrusion of a composite body consisting of three round blanks, the round blank provided for the spark tip either being of virtually the same diameter as the round blanks for the core and for the shell, or having a smaller diameter, with the result that this round blank can be inserted into a throughhole in the round blank for the shell. The spark section made from the noble metal is not, however, reliably attached to the shell and to the core of this centre electrode, and in the event of the loss of the spark section the spark plug does not have adequate emergency running properties in this region.

German Offenlegungsschrift 3,607,243 discloses a method for producing spark plug centre electrodes by impact extrusion, in which the starting point is, once again, a composite body, which is assembled from three initial parts of different material; the finished electrode in this case has a shell of corrosion-resistant material (for example nickel alloy), a core surrounded by the shell and made from a material of high thermal conductivity, and a spark section which consists of noble metal and is fixed in a blind bore in the floor of the shell on the combustion-chamber side. In this electrode, however, the electrode core, which efficiently conducts the heat, is separated from the spark section by a part of the shell floor, and the heat flow in the electrode is obstructed as a result. The production of the composite body of this electrode is, however, relatively complex from the point of view of mass production, because the rod-shaped initial part for the core has to be inserted into the deep blind bore on the connection side, and the pin-shaped initial part of the spark section has to be inserted into the blind bore, on the combustion-chamber side, of the initial part for the shell.

A method similar to that in the previously described German Offenlegungsschrift 3,607,243 is also disclosed in German Offenlegungsschrift 3,433,683: instead of a pin-shaped initial part for the spark section, use is made here of a disc-shaped initial part.

DE-AS 2,614,274 describes a spark plug with electrodes which have a silver core, which is surrounded by a tubular nickel shell, and in which the silver core is exposed on the end face on the combustion-chamber side. Such electrodes can be used in functional terms, but they have a relatively high fraction of silver which makes these electrodes expensive.

U.S. Pat. No. 2,296,033 exhibits spark plugs with centre and earth electrodes which have a design like the electrodes of the previously mentioned DE-AS 2,614,274, but whose end faces on the combustion-chamber side additionally are also further provided with welded-on spark sections made from platinum or platinum alloys. The production process of such electrodes by hammering and welding is, however, very complex; furthermore, the emergency running properties of such electrodes are poor in the event of loss of the welded-on spark sections.

SUMMARY OF THE INVENTION

By contrast, it is the object of the invention to develop a method for producing long-life spark plug electrodes or electrodes of a type which have a shell made from a material that is as corrosion-resistant as possible, and a core that is surrounded by the shell and is made from a material of high thermal conductivity, and the core of which is covered on its end face on the combustion-chamber side by a low-volume region of an erosion-resistant material, the erosion-resistant region being lastingly reliably retained even in the case of the stresses in modern high-efficiency internal combustion engines; the production process of these electrodes is to be suitable for economical mass production.

It is particularly advantageous when a low-volume fourth material section made from highly erosion-resistant material (for example platinum or a Pt-alloy) is arranged as spark section on the combustion-chamber side in front of the erosion-resistant material (for example silver or a silver alloy); even given wear of the highly erosion-resistant material after a long lifetime, because of the adjoining erosion-resistant material the spark plug still has emergency running properties over many kilometres. The mixture accessibility of the spark gap of the spark plug can be improved by reducing the end section of the electrode on the combustion-chamber side.

These electrodes can also be further processed into earth electrodes by embossing, if necessary by additional bending in the shape of a hook.

DRAWING

Exemplary embodiments of the invention are represented in the drawing and explained in more detail in the following description.

FIG. 1 shows an enlarged representation of the side view of the region on the combustion-chamber side of a spark plug, FIG. 2 shows a first embodiment of three initial parts, represented enlarged and in side view, for a spark plug centre electrode according to the invention, FIG. 3 shows a longitudinal section through a composite body which is assembled from the three initial parts shown in FIG. 2, FIG. 4 shows a vertical section through an impact extrusion die, represented diagrammatically and having an inserted composite body in accordance with FIG. 3, FIG. 5 shows a longitudinal section through a centre electrode blank, impact-extruded from the composite body in accordance with FIG. 3, on which a collar and radial anchor lugs have subsequently already been integrally formed on the head side, FIG. 6 shows a longitudinal section through the centre electrode according to the invention, which is formed from three initial parts and has an exposed region on the combustion-chamber side that is made from erosion-resistant material, FIG. 7 shows a second embodiment of three initial parts, represented enlarged and in side view, for a spark plug centre electrode according to the invention, FIG. 8 shows a longitudinal section through the composite body, which is assembled from the initial parts shown in FIG. 7, FIG. 9 shows a first embodiment of four initial parts, represented enlarged and in side view, for a spark plug centre electrode according to the invention, FIG. 10 shows a longitudinal section through a composite body, which is assembled from the four initial parts shown in FIG. 9, FIG. 11 shows a longitudinal section through a centre electrode blank, impact-extruded from the composite body in accordance with FIG. 10, on which a collar and radial anchor lugs have subsequently already been integrally formed on the head side, FIG. 12 shows a longitudinal section through the centre electrode according to the invention, which is formed from four initial parts and has an exposed region on the combustion-chamber side that is made of a highly erosion-resistant material, FIG. 13 shows a second embodiment of four initial parts, represented enlarged and in side view, for a spark plug centre electrode according to the invention, FIG. 14 shows a longitudinal section through the composite body, which is assembled from the initial parts shown in FIG. 13, FIG. 15 shows a part section through the region, on the combustion-chamber side and further enlarged, of a centre electrode in accordance with FIG. 12, the end section on the combustion-chamber side having additionally been reduced in diameter and constructed cylindrically, FIG. 16 shows a region, on the combustion-chamber side and likewise further enlarged, of a centre electrode in accordance with FIG. 12, the end section on the combustion-chamber side having additionally been constructed as a conical frustum which tapers towards the electrode end face, FIG. 17 shows an earth electrode blank, represented enlarged, which is produced by embossing of a centre electrode blank assembled from three or four initial parts, FIG. 18 shows the cross-section through the earth electrode blank in accordance with FIG. 17, along to the line M/M, FIG. 19 shows a longitudinal section through an earth electrode cut to length, which is to be attached to the spark plug shell, has been produced from three initial parts, and can further be bent in the shape of a hook or the like, if necessary, and FIG. 20 shows a longitudinal section through an earth electrode cut to length, which is to be attached to the spark plug shell, has been formed from four initial parts, and can further be bent in the shape of a hook or the like, if necessary.

DETAILED DESCRIPTION OF THE EXEMPLARY EMBODIMENTS

Figure 1:
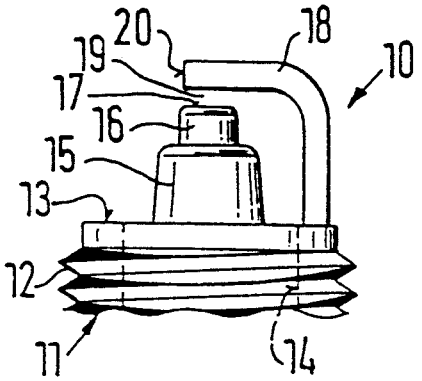

Represented in FIG. 1 is the region on the combustion-chamber side of a conventional spark plug 10:

The spark plug shell 11 is provided on the combustion-chamber side with an internal thread 12 for installing the spark plug 10 in an internal combustion engine. The end face on the combustion-chamber side of the spark plug shell 11 is designated by the reference numeral 13. In this embodiment of a spark plug 10, there projects from the longitudinal bore, indicated and designated by the reference numeral 14, of the spark plug shell 11, an insulating body 15 which comprises a centre electrode 16 in its axial bore, which is not represented; the end face 17 on the combustion-chamber side of the centre electrode 16 is located at a distance from the end section of an earth electrode 18 bent in the shape of a hook. The end of the earth electrode 18 opposite the free end is attached to the end face 13 of the spark plug shell 11, for example by welding. The interspace located between the end face 17 of the centre electrode 16 and the free end section of the earth electrode 18 represents the spark gap 19 of the spark plug 10.

Whereas the spark plug 10 described above has a spark gap 19 arranged on the combustion-chamber side in front of the spark plug shell 11, there are, however, also spark plugs that are known in which the spark gap is located inside the longitudinal bore 14 of the shell. In such spark plugs, use is generally made not of hook-shaped but of straight earth electrodes; the straight earth electrodes are also attached to the spark plug shell 11 and can be located with their free end section at a distance on the combustion-chamber side in front of the end face 17 of the centre electrode 16, but they can also be aligned such that they point with their free end face 20 radially to the end section on the combustion-chamber side of the centre electrode 16. Earth electrodes 18 which are located with their free end section opposite the end face 17 of the centre electrode 16 can project over the entire end face 17 but, if necessary, can also—depending on the internal combustion engine—cover only a part of the end face 17. In yet another embodiment of a spark plug, the end face 17 of the centre electrode 16 and the free end face 20 of the earth electrode 18 are located opposite one another at a distance. The position of the spark gap 19 and the configuration or arrangement of the earth electrode 18, if necessary the number of the earth electrodes on a spark plug, are determined by the requirements and conditions of the internal combustion engine, but are not relevant to the present invention, since the electrodes according to the invention can be advantageously used for all these spark plugs.

Impact extrusion methods for producing spark plug electrodes, including those which are assembled from a plurality of material regions, are known in principle, and have been described in the descriptive introduction. Such impact extrusion methods can be used economically for mass production of electrodes, and have proved themselves well for this purpose. Because of the more stringent requirements of spark plugs in modern high-efficiency internal combustion engines, and with a view to the demand for a longer lifetime, spark electrodes which fulfil these demands are required.

A first method for producing such a centre electrode 16 for spark plugs 10 is described with the aid of FIGS. 2 to 6.

Figure 2:
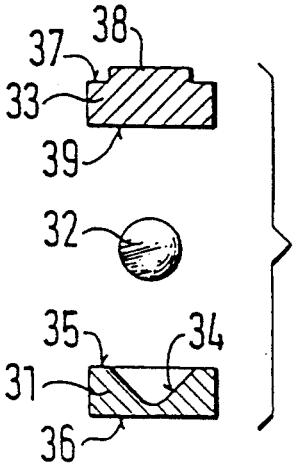
Figure 3:
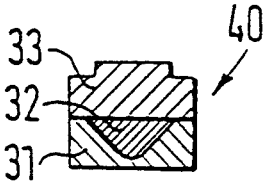
Figure 6:
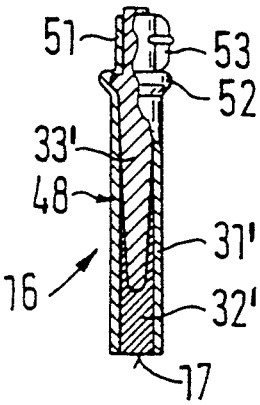

FIG. 2 shows three initial parts 31, 32 and 33 for an embodiment of a centre electrode 16. The initial part 31 is constructed as a round blank which consists of corrosion-resistant material (for example nickel or nickel alloy) and in the case of the finished centre electrode 16 in accordance with FIG. 6 is intended to form the shell 31' thereof. This initial part 31 for the shell has a blind bore 34 which is arranged in the centre of its topside 35; the blind bore 34 is preferably constructed like a cone or conical frustum, but can also have a different configuration, and projects with its smallest diameter up to near the underside 36 of the initial part 31 for the shell.

The initial part 32 for the erosion-resistant region 32' of the finished centre electrode 16 in accordance with FIG. 6 is inserted in this blind bore 34 of the initial part 31 for the shell. This initial part 32 preferably has the shape of a sphere; however, the initial part 32 can also be of a different configuration, for example a bar segment or a cone, the only essential point being that its volume completely fills out the blind bore 34 in the initial part 31 for the shell. This initial part 32 for the erosion-resistant region 32' consists of silver or a silver alloy; the following silver alloys have proved to be particularly good for this purpose:

AgNi with an Ni fraction of up to 0.15% (fine-grained silver),

AgTi with a Ti fraction of up to 5%, $AgSnO_2$ with an $SnO_2$ fraction of from 2 to 15%, or AgPd with a Pd fraction of from 2 to up to 6%.

However, in addition to the abovementioned materials other known materials suitable for this purpose, for example, apart from silver, other noble metals as well, are suitable for this erosion-resistant region 32'.

The two initial parts 31 and 32 previously described are then heated in such a way that the initial part 32 melts and completely fills out the blind bore 34 in the initial part 31 for the shell.

The initial part 33 in the shape of a round blank, of the centre electrode core 33', which consists of a material of high thermal conductivity, is then placed on this heated arrangement; it is preferred to use copper or a copper alloy as the material for this initial part 33 for the core. The initial part 33 for the core has the same diameter as the initial part 31 for the shell and is provided on its top side 37 with a coaxial lug 38 for reasons of manipulation corresponding to production requirements. It was decided to forego representation of radii or chamfering on the initial parts 31 and 33, which can likewise serve for manipulation corresponding to production requirements. An auxiliary device can be used for the axial alignment and connection of the initial parts 31 and 33. The initial part 33 for the core is coaxially connected at its underside 39 to the two other initial parts 31 and 32, the molten initial part 32 serving as solder. Alternatively, the initial part 31 for the shell can also be connected by welding, for example by resistant welding, to the initial part 32, melted and cooled in the blind bore 34 of the initial part 31 for the shell, of the erosion-resistant region, on the one hand, and to the initial part 33 for the core, on the other hand. Depending on the materials used for the initial parts 31, 32, 33, it is possible, if necessary, to make use on these parts of coatings (for example made from silver) which facilitate the connecting process. It is preferred to arrange between the initial part 33 for the core and the erosion-resistant region or initial part 32 consisting of silver or a silver alloy a layer (not represented) which is capable of preventing undesired oxidation in the contact regions, and thus of preventing poorer thermal conductivity and even spark plug defects; examples of suitable materials for such a layer are nickel and platinum. In terms of production engineering, such a layer can be produced when the initial part 33 of the core is coated with the nickel or platinum, or when a foil made from nickel or platinum is additionally arranged on the underside 39 of the initial part 33 for the core. The arrangement assembled from the initial parts 31, 32 and 33 and cooled produces a composite body which is designated by the reference numeral 40 (see FIG. 3); this composite body 40 is the initial part for the subsequent impact extrusion method.

Figure 4:
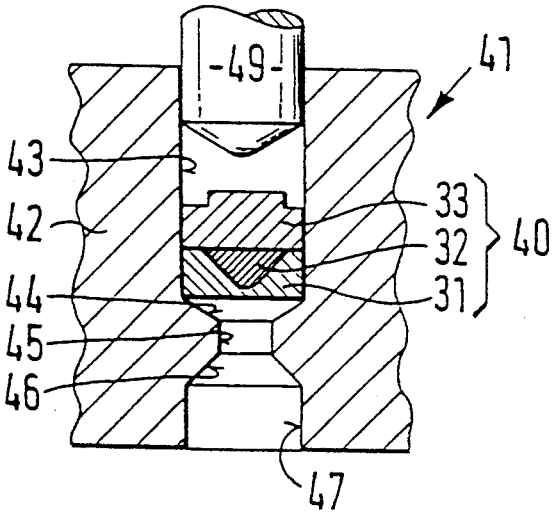
Figure 5:
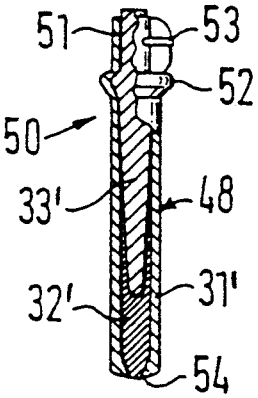

Represented diagrammatically in FIG. 4 is a die 41 for the impact extrusion of spark plug electrodes 16. This impact extrusion die 41 has a cavity block 42 which has an accommodating bore 43 for the initial parts 31, 32, 33 for the electrodes or the composite body 40; this accommodating bore 43 merges coaxially into an oblique shoulder 44 reducing in diameter and then into the impact extrusion opening 45. The impact extrusion opening 45 then subsequently merges via a shoulder 46 increasing in diameter into a bore 47. The diameter of the accommodating bore 43 is dimensioned such that the initial parts 31 and 33 or the composite body 40 come to bear with their circumferential surfaces against the wall of the accommodating bore 43; the diameter of the impact extrusion opening 45 of the die 41 corresponds to the diameter of the shank 48 of the centre electrode 30 (see FIG. 6). The initial parts 31, 32, 33 or the composite body 40 are firstly appropriately inserted from above in the accommodating bore 43, the initial part 31 for the shell being turned towards the impact extrusion opening 45, and then an impact extrusion punch 49 is slaved in a known way; the impact extrusion punch 49 is subsequently pressurised and presses the initial parts 31, 32, 33 or the composite body 40 partially through the impact extrusion opening 45; only a head section remains above the impact extrusion opening 45. Shown in FIG. 5 is the electrode blank 50, which was removed from the impact extrusion die 41 by means of an ejector (not represented), and on whose head located on the connection side a collar 52 and anchor lug 53 have additionally been integrally formed. In the case of this electrode blank 50 a tubular shell 31' made from corrosion-resistant material has been formed from the initial part 31, an erosion-resistant region 32 bounded laterally by the shell 31 and on the combustion-chamber side by a shell floor 54 has been produced from the initial part 32, and a core 33', which is made from a material of high thermal conductivity and is likewise surrounded laterally by the shell 31' but is free on the connection side, has been formed from the initial part 33; depending on the configuration of the blind bore 34 in the initial part 31 for the shell, the floor 54 of the shell 31' is entirely or only partially closed.

In order for the electrode 16 to have its precise length, and for as large as possible a cross-section of the erosion-resistant region 32' to be exposed, the end section on the combustion-chamber side of the electrode blank 50 is correspondingly machined; it is preferred for the electrode end face 17 to be produced by grinding.

The method described above for producing centre electrodes can, however, also be modified, with the essential features, however, being retained. Thus, in the method steps it is possible, for example, to forego connecting the initial parts 31, 32, 33 into a composite body 40; in this case, however, it is assumed that the size and the shape of the initial parts 31, 32, 33 have a high accuracy.

Figure 7:
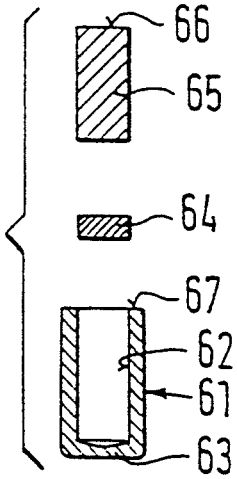
Figure 8:
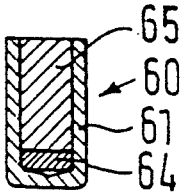

Another possibility for manufacturing a composite body 60 provided for the purpose of impact extrusion is to be seen from FIGS. 7 and 8:

In this case, the starting points for the initial parts 61 for the shell 31' of the centre electrode 16 in accordance with FIG. 6 is a cup whose round circumference is dimensioned such that it fits closely seated into the accommodating bore of an impact extrusion die. This impact extrusion die has essentially the design of the impact extrusion die represented in FIG. 4; the diameter of the accommodating bore and the punch are matched to the outside diameter of the initial part 61. The floor of the initial part 61 for the shell is designated by the reference numeral 63.

An initial part 64 for the erosion-resistant region 32' of the centre electrode 16 in accordance with FIG. 6 is subsequently inserted to the blind bore 62 of the initial part 61 for the shell; this initial part 64 is preferably a round blank having a round circumference, but can also be of a different shape, for example spherical or bar-shaped. These two initial parts 61 and 64 are preferably heated so that the initial part 64 melts in the blind bore 62 of the cup-shaped initial part 61.

In the next method step, a bar-shaped initial part 65, which fills out the cross-section of the blind bore 62, for the core 33' of the centre electrode 16 is inserted into the free space, not taken up by the molten initial part 64, of the initial part 61 for the shell; after melting of the initial part 64, the upper end face 66 of the initial part 65 for the core is preferably sealed flush with the annular topside 67 of the initial part 61 for the shell, but can, if necessary, also project a little over the abovementioned topside 67. In accordance with a divergent method, however, the initial part 65 for the core can also already be inserted above the initial part 64 into the blind bore 62 when the initial part 64 has not yet been melted. In this case, the three initial parts 61, 64 and 65 are jointly heated so as to melt the initial part 64 for the erosion-resistant region. It is advantageous when after melting of the initial part 64 pressure is exerted by means of a punch (not represented) on the initial part 65 for the core. The bar-shaped initial part 65 for the core is held in the initial part 61 for the shell by the molten initial part 64 and/or also as a result of the shrinking of the diameter of the blind bore 62. For the rest, all the features that have been described previously also hold for these variant methods.

Figure 9:
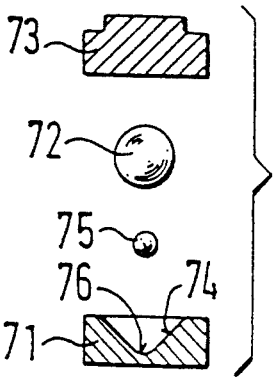
Figure 10:
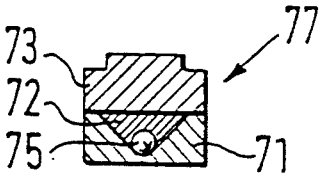
Figure 12:
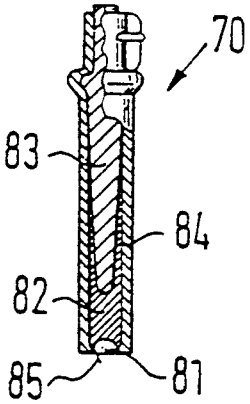

A further improvement of the electrode properties, in particular a lengthening of the lifetime, can be achieved by the additional method features described below with the aid of FIGS. 9 to 12:

Represented in FIG. 9—as in FIG. 7—are initial parts for a centre electrode 70 to be impact extruded (see FIG. 12). The initial part 71 for the shell, which is arranged uppermost, corresponds to the initial part 31 for the core, the initial part 72 for the erosion-resistant region corresponds to the initial part 32, and the initial part 73 for the core corresponds to the initial part 33. However, the very low-volume initial part 75 for a highly erosion-resistant region 81 of a centre electrode in accordance with FIG. 12 is firstly inserted in the blind bore 74 of the initial part 71 for the shell; this initial part 75 is preferably constructed as a sphere, and preferably consists of a platinum metal or an alloy of platinum metals, but can also be composed from a platinum metal and another metal. The initial part 72 for the erosion-resistant region 82 is subsequently also inserted into the blind bore 74 and then this arrangement is heated until the initial part 72 melts. In this case, the highly erosion-resistant initial part 75, which has a higher melting point, will arrange itself at the lowest point 76 of the blind bore 74 in the initial part 71 for the shell; it is advantageous when the region of the lowest point 76 in the initial part 71 for the shell is formed in such a way that the spherical surface of the initial part 75 for the highly erosion-resistant region 81 makes two-dimensional contact. In this augmented method, the size of the initial part 72 for the erosion-resistant region 82 is to be dimensioned such that it fills out the blind bore 74 flush after melting. As also in the first exemplary embodiment (see FIG. 3), the initial part 73 for the core is then attached to this arrangement with the aid of an auxiliary device (not represented). The composite body 77 thus produced is represented in FIG. 10.

Figure 11:
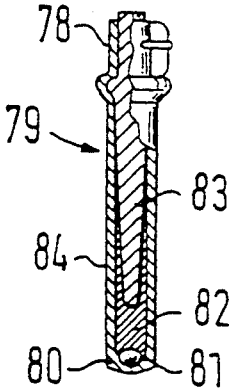

This composite body 77 assumes the appearance of the electrode blank 79 represented in FIG. 11 after the impact extrusion and embossing of a head 78. Like the blank in accordance with FIG. 5, as well, the electrode blank 79 has on the combustion-chamber side a more or less closed shell floor 80, which is then adjoined on the connection side firstly by the low-volume region 81 of the highly erosion-resistant material (for example platinum), then by a region 82 of erosion-resistant material (for example silver), and thereafter by the core 83 (for example copper). When the section on the combustion-chamber side of the electrode blank 79 is subsequently cut to length, the highly erosion-resistant region 81 is exposed and then ensures that the centre electrode 70 has a particularly long lifetime. Since this highly erosion-resistant region 81 is extremely small, such an electrode 70 would still have emergency running properties over many kilometres even given wear of this region 81. The shell of this electrode is designated by the reference numeral 84, and the end face of the combustion-chamber side by the reference numeral 85.

Figure 13:
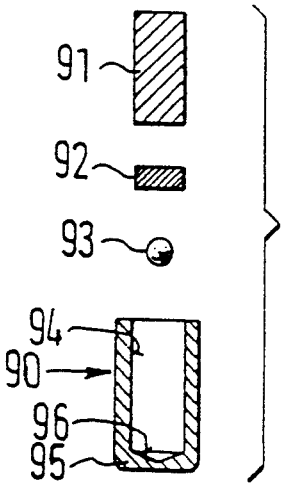
Figure 14:
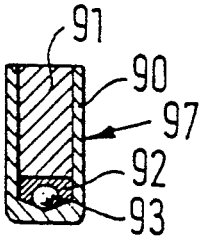

Alternatively, such a centre electrode 70 in accordance with FIG. 12, which is assembled from four material regions, can in principle also be produced according to the method represented in FIGS. 7 and 8. It is shown in FIG. 13 that the initial part 90 for the shell is once again constructed in a cup-shaped fashion in this method, that the initial part 91 for the core is also once again configured as a bar, and that the initial part 92 for the erosion-resistant region 82 is likewise once again cylindrical or has a different configuration (for example spherical). These three initial parts 90, 91, 92 are still to be complemented in addition by an initial part 93 for the highly erosion-resistant region 81; during assembly of the initial parts, this additional initial part 93 is firstly inserted into the blind bore 94 of the initial part 90 for the shell. Preferably, the inside of the floor 95 of the initial part 90 for the shell is provided with a centrally arranged, conical depression 96, and the initial part 93 for the highly erosion-resistant region 81 is constructed as a sphere; as a consequence of this configuration of the floor 95 of the initial part 90 for the shell, and of the initial part 93, the volume of the latter can be kept particularly low. Further processing of the initial parts 90 to 93 set forth is performed in accordance with the method steps which have already been described with reference to the exemplary embodiments according to FIGS. 7 and 8. The composite body 97 produced using this method is represented in FIG. 14, and is impact extruded and machined as is also described in the previous exemplary embodiments; what has been said in the preceding exemplary embodiments concerning the materials used applies correspondingly in this exemplary embodiment.

Figure 15:
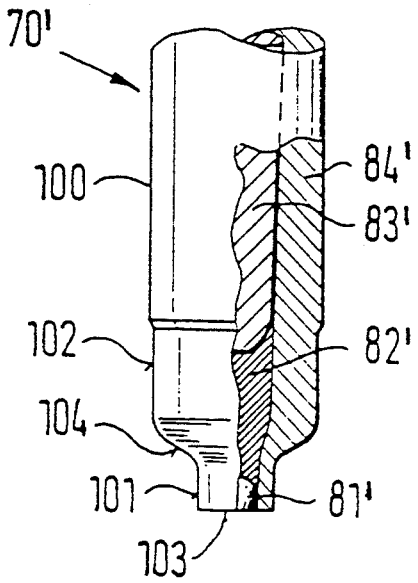

In order, in a spark plug 10 with one of the centre electrodes 16, 70 described, to improve the accessibility of the fuel vapor/air mixture to the spark gap 19, and also to keep low the need for relatively expansive initial materials for their erosion-resistant or highly erosion-resistant regions, the section on the combustion-chamber side of the centre electrodes 16, 70 can be constructed with a smaller diameter than the shank thereof 100, 100'; the centre electrode region concerned is represented in this way in FIG. 15 with the aid of a centre electrode 70 in accordance with FIG. 12. In this FIG. 15, the shell of this centre electrode 70' is designated by 84', the core by 83', the erosion-resistant region [lacuna] 82', and the highly erosion-resistant region by 81'. In this case, the shank 100 of this centre electrode 70' has the diameter produced according to the impact extrusion method described, while the cylindrical end section 101 on the combustion-chamber side has a reduced diameter. In an example of such a centre electrode 70', the diameter of the shank 100 can be approximately 2.7 millimetres, and the diameter of the end section 101 on the combustion-chamber side approximately 1.2 millimetres. The diameter of the highly erosion-resistant region 81' can be 0.8 millimetres, and its thickness 0.35 millimetres. The region 82' made from erosion-resistant material and following the region 81' on the connection side can extend in the axial direction over a length of approximately 2 to 4 millimetres.

The region 102 which adjoins the end section 101 on the combustion-chamber side and comes to be arranged in the end section on the combustion-chamber side of the insulating body 15 when the spark plug 10 is in its final assembled state is also provided, in a known way, with a diameter which is slightly smaller than the diameter of the centre electrode shank 100; this measure, which is known per se, prevents the insulating body 15 from bursting owing to the thermal expansion of the centre electrode 70' when a warm spark plug 10 is in operation.

Figure 16:
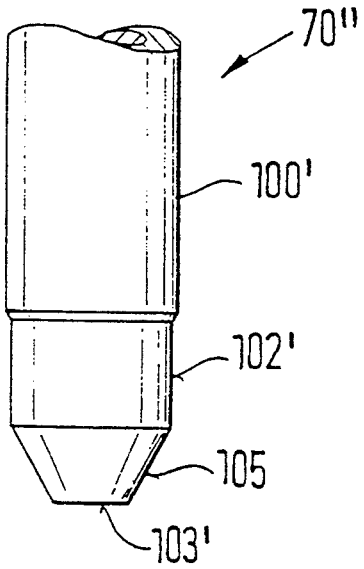

Whereas in FIG. 15 the transition to the region 102 from the cylindrical end section 101 on the combustion-chamber side takes place in the case of the centre electrode 70' via an obliquely situated shoulder 104, FIG. 16 alternatively shows a centre electrode 70'' whose design corresponds to the centre electrode 70', but whose transition surface 105 from the end face 103' on the combustion-chamber side extends directly and continuously, preferably in the shape of a conical frustum, to the adjoining region 102'. The shank of this electrode 70'' is denoted by the reference numeral 100'.

The regions 101 and 102 or 101' and 102' of reduced diameter are produced by means of known rotary swaging; in such centre electrodes 70', 70'', the end faces 103, 103' on the combustion-chamber side are expediently not ground until after the rotary swaging of the relevant regions 101, 102 or 101' and 102'.

Figure 17:
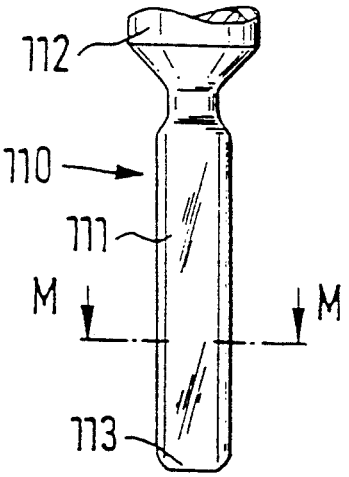
Figure 18:
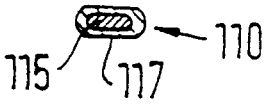
Figure 19:
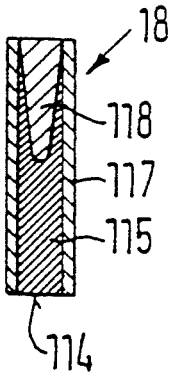
Figure 20:
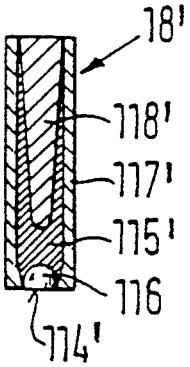

The electrodes according to the invention, which are assembled from at least three different regions, can also be further processed into earth electrodes 18. In the case of spark plugs 10 for modern high-efficiency internal combustion engines, such earth electrodes 18 are exposed, like the centre electrodes 16 to exceptional stresses, and must be capable of dissipating heat quickly over the spark plug shell 11, and thus of avoiding glow ignitions. Shown in FIGS. 17 and 18 is an electrode blank 110 for an earth electrode 18 or 18' in accordance with FIGS. 19 or 20, which is reduced by impact extrusion of a composite body in accordance with FIGS. 3, 8, 10 or 14, but in the region of the shank 111 has then additionally been provided by means of embossing with a cross-section corresponding to FIG. 18. In order to finish the earth electrode 18 or 18', as represented in FIGS. 19 or 20, the head 112 and, in the case of most spark plug types, the free end section 113, as well, are separated from the electrode blank 110 in such a way that the electrode 18, 18' receives its required length and on its end face 114, 114' on the combustion-chamber side the erosion-resistant region 115 (FIG. 19) or the highly erosion-resistant region 116 (FIG. 20) is exposed. The method step of "bending", which is to be undertaken either in the case of the earth electrode 18, 18' as an individual part or not until the earth electrode 18, 18' has already been attached to the end face 13 of the spark plug shell 11, is to be undertaken in the case of hook-shaped earth electrodes 18, 18'. In the case of the earth electrode 18 which is bent in the shape of a hook and projects partially or entirely over the end face 17 of the centre electrode 16, it is also possible to free from the shell 117, 117' at least one region of the earth electrode 18, 18' which faces the centre electrode end face 17, in order to expose the erosion-resistant region 115, 115' and/or the highly erosion-resistant region 116 (not represented); the exposure of these regions 115, 115', 116 can, for example, also be produced by grinding or also by milling. The shell of the earth electrode 18 or 18' is designated in FIGS. 18 to 20 by 117 or 117', and the core by 118 or 118'.

The electrodes according to the invention withstand the high stresses in modern high-efficiency internal combustion engines, and can be economically produced in known and proven mass production devices.

We claim:

1. A method of producing a long-life spark plug electrode (16,18) by applying a movable punch (49) against a composite blank (77) in a hollow extrusion die (41), said composite blank containing a first, shell component (31,71) of corrosion-resistant material, a second component (32,72) of erosion-resistant material, and a third component (75) of highly erosion-resistant material, and a fourth, core component (33,73) of thermally conductive material, thereby impact-extruding said composite blank (77) to form an elongated electrode blank (79), comprising the steps of a) forming a blind bore or recess (34,62,74) in said shell component (31,71) and aligning said bore with an open end thereof facing upward;

b) dimensioning said second and third components to occupy a volume equal to that of said bore in said shell component, heating said third component (75) until it melts and covers a lowest point (76) in said bore, and heating said second component (32,72) until it melts and fills a remaining portion of the volume of said bore (74);

c) welding or soldering said fourth, core component (33,73) onto said first, second, and third components at a position covering said blind bore and components therein;

d) inserting the thus-formed composite blank (77) into an accomodating cavity (43) of said extrusion die (41) with said fourth, core component (33,73) closest to said punch (49);

e) applying said punch (49) axially against said composite blank (77), thereby producing said electrode blank (79) by impact-extrusion; and f) cutting, to a desired length, the impact-extruded elongated electrode blank (79) in such a way that highly erosion-resistant material of said third component (75) is exposed, thereby defining a highly erosion-resistant surface region (82) at an end face (17) of said spark plug electrode.

2. Method according to claim 1, wherein the highly erosion-resistant region consists essentially of a material selected from the group consisting of a platinum metal, and an alloy of a platinum metal with another metal.

3. A method according to claim 1, characterized in that a spherical part is used for the initial part (75) of the highly erosion-resistant region.

4. A method according to claim 1 characterized in that the end face (17, 85, 103, 103', 114, 114') on the the electrode (16, 18, 18', 70, 70', 70'') is machined by grinding.

5. Method according to claim 1, characterised in that copper or a copper alloy is used as the material for the electrode core (33', 83, 83', 118, 118'), and nickel or a nickel alloy is used as the material for the electrode shell (31', 84, 84', 117, 117').

6. A method according to claim 1, characterized in that the end face 103,103') on the combustion-chamber side is reduced in diameter by comparison with the shank (100,100') of the electrode (70', 70'').

7. A method according to claim 6, characterized in that the end face (103, 103') on a combustion-chamber side of the electrode (70', 70'') is provided with a smaller diameter than an electrode longitudinal section (102,102'), which is adjacent thereto on the connection side and has already been reduced in cross-section by contrast with the electrode shank (100,100').

8. Method according to claim 1, characterized in that the impact-extruded electrode blank (110) is embossed.

9. Method according to claim 8, characterized in that the head (112) on the connection side is separated from the electrode blank (110).

10. Method according to claim 8, characterized in that the electrode (18,18') is bent in the shape of a hook.

11. Method according to claim 1, characterised in that silver or a silver alloy is used for the region of the erosion-resistant material (32', 82, 82', 115, 115').

12. Method according to claim 11, wherein said erosion resistant material is a material selected from the group consisting of AgNi with an Ni fraction of up to 0.15% (fine-grained silver), AgTi with a Ti fraction of up to 5%, $AgSnO_2$ with an $SnO_2$ fraction of from 2 to 15%, and AgPd with a Pd fraction of from 2 to 6%.

13. Impact-extruded electrode (16, 18, 18', 70, 70', 70'') for spark plugs (10) produced in accordance with the method of claim 1, having a shell (31', 84, 84', 117, 117') made from corrosion-resistant material, having a core (33', 83, 83', 118, 118') made from a material of high thermal conductivity, and having an erosion-resistant region (32', 82, 82', 115, 115') which is arranged on the combustion-chamber side of the core and is surrounded coaxially by the shell, characterized in that the erosion-resistant region consists of an alloy selected from the group consisting of:

AgNi with an Ni fraction of up to 0.15% (fine-grained silver),

AgTi with a Ti fraction of up to 5%, $AgSnO_2$ with an $SnO_2$ fraction of from 2 to 15%, and AgPd with a Pd fraction of from 2 to 6%.

14. Impact-extruded electrode according to claim 13, characterised in that there is arranged on the combustion-chamber side of the erosion-resistant region (82, 82', 115') a region (81, 81', 116) of a highly erosion-resistant material which is still firmly coaxially completely surrounded by the shell (84, 84', 117').

* * * * *